US007985045B2

(12) United States Patent
Narita et al.

(10) Patent No.: US 7,985,045 B2
(45) Date of Patent: Jul. 26, 2011

(54) STEAM TURBINES, SEALS, AND CONTROL METHODS THEREFOR

(75) Inventors: Kenjiro Narita, Hitachinaka (JP); Takeshi Kudo, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 1041 days.

(21) Appl. No.: 11/779,463

(22) Filed: Jul. 18, 2007

(65) Prior Publication Data

US 2008/0019821 A1 Jan. 24, 2008

(30) Foreign Application Priority Data

Jul. 20, 2006 (JP) ..... 2006-197803

(51) Int. Cl.
*F01D 21/14* (2006.01)

(52) U.S. Cl. ..... 415/14; 415/176; 415/178; 415/230

(58) Field of Classification Search ..... 415/14, 415/175, 176, 177, 178, 230
See application file for complete search history.

(56) References Cited

U.S. PATENT DOCUMENTS 7,037,065 B2 * 5/2006 Reigl ..... 415/47
7,549,834 B2 * 6/2009 Kirchhof et al. ..... 415/1

FOREIGN PATENT DOCUMENTS

JP 62-34103 2/1987
JP 04325702 A * 11/1992

* cited by examiner

*Primary Examiner* — Edward Look
*Assistant Examiner* — Dwayne J White
(74) *Attorney, Agent, or Firm* — Mattingly & Malur, PC

(57) ABSTRACT

A steam turbine comprises a rotor with moving blades attached thereto; diaphragms which surround the rotor from an outer periphery side of the rotor; a casing which encloses the diaphragms and the rotor and has an upper half and a lower half clamped together through respective flanges; a displacement detector for measuring a difference d in thermal expansion in the rotor axis direction between the casing and the rotor; heating/cooling devices attached to the flanges respectively to heat and cool the flanges; and a controller which makes control so that the flanges are heated or cooled by the heating/cooling devices until a measured value obtained by the displacement detector reaches a preset value M or S in unsteady operation.

15 Claims, 13 Drawing Sheets

STEAM TURBINES, SEALS, AND CONTROL METHODS THEREFOR

BACKGROUND OF THE INVENTION

1. Field of the Invention

The present invention relates to steam turbines for obtaining energy with use of steam, seals disposed outside the steam turbines in a rotor radial direction to suppress the leakage of steam, and methods for controlling the steam turbines and the seals.

2. Description of the Prior Art

As one effective means for improving the efficiency of a steam turbine it is known to shorten the time required for unsteady operation such as start and stop of the steam turbine.

Usually, when starting up a steam turbine, a relative rotor expansion in the corresponding cylinder caused by a difference in heat capacity between a rotor with moving blades attached thereto and a casing which houses the rotor therein is controlled by warming up the steam turbine gradually. In this way the state of the steam turbine is changed slowly up to the state of its steady operation while preventing the rotor relatively small in heat capacity in comparison with the casing from expanding to excess with respect to the casing and causing shaft vibration (rubbing vibration), and thereafter the steam turbine is started up. Thus, for shortening the time required for unsteady operation, it is necessary to solve the problem of the relative rotor expansion in the corresponding cylinder.

As a technique for diminishing the problem of the relative rotor expansion in the corresponding cylinder and shortening the unsteady operation time there has been proposed a technique wherein a heat medium flowing passage is attached to the outer periphery surface of the casing which is larger in heat capacity than the rotor, thereby heating (or cooling) the whole of the casing in advance (see, for example, JP-U-62-34103).

However, the above technique premises warming-up or cooling of the entire casing and is less effective in the case where steam necessary for warming up or cooling the casing cannot be supplied sufficiently, thus its practical application sometimes encounters difficulty. Besides, as to improving the efficiency in steady operation which is associated with shortening the unsteady operation time by preheating or precooling, no appropriate measure has been considered. Thus, it is necessary to improve the efficiency of the steam turbine from a synthetic standpoint taking a series of flows from start to stop into account.

SUMMARY OF THE INVENTION

It is an object of the present invention to improve the efficiency of a steam turbine.

According to the present invention, to achieve the above-mentioned object, there is provided a steam turbine comprising: a rotor with moving blades attached thereto; diaphragms which surround the rotor from an outer periphery side of the rotor; a casing which encloses the diaphragms and the rotor; the casing comprising an upper half and a lower half clamped together through respective flanges; measuring means for measuring a difference in thermal expansion in the rotor axis direction between the casing and the rotor; heating/cooling means attached to the flanges respectively to heat and cool the flanges; and a controller which makes control so that the flanges are heated or cooled by the heating/cooling means until a measured value obtained by the measuring means reaches a preset value in unsteady operation.

According to the present invention it is possible to suppress the leakage of steam during operation of the steam turbine while shortening the time required for unsteady operation and hence possible to improve the efficiency of the steam turbine.

DETAILED DESCRIPTION OF PREFERRED EMBODIMENTS

Embodiments of the present invention will be described hereinunder with reference to the accompanying drawings.

First, a description will be given about a first embodiment of the present invention with reference to FIGS. 1 to 7.

Figure 1:
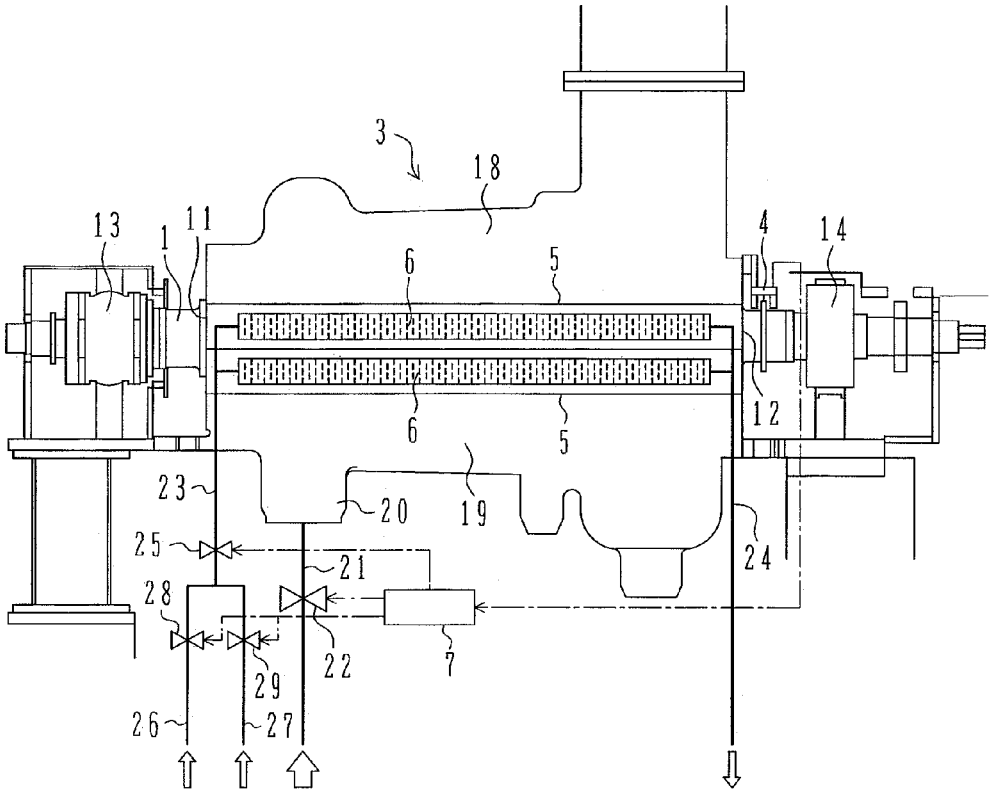
FIG. 1 is a side view of a steam turbine according to a first embodiment of the present invention.
Figure 2:
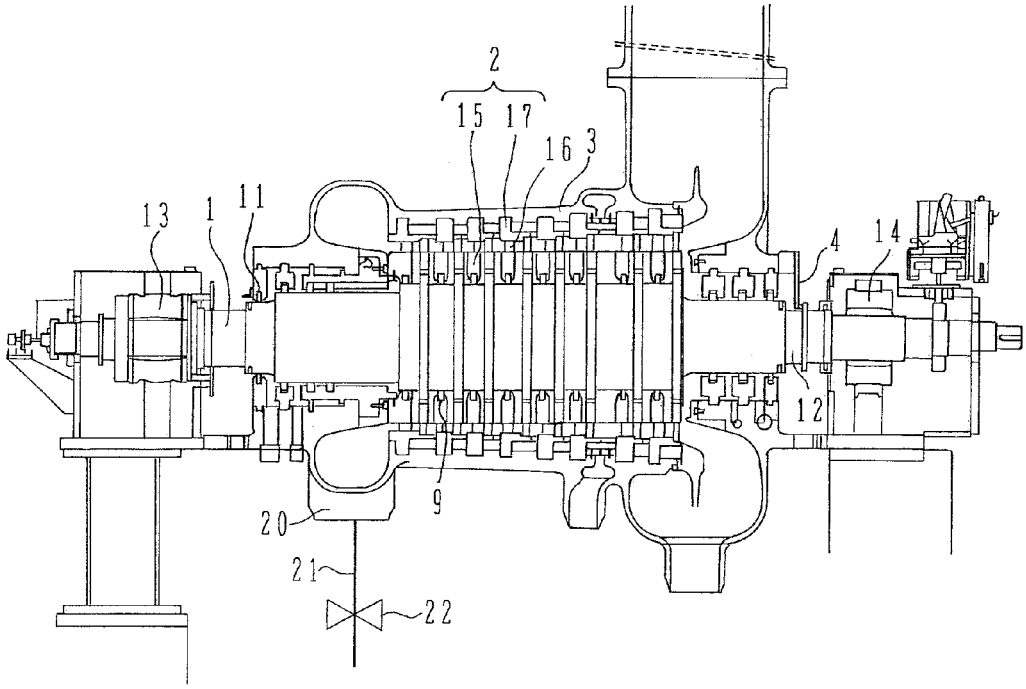
FIG. 2 is a sectional view thereof.
Figure 3:
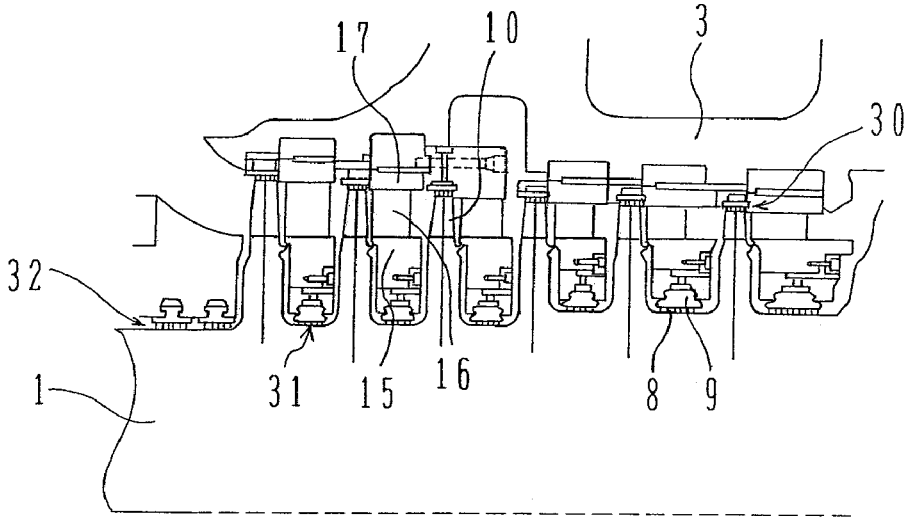
FIG. 3 is an enlarged diagram of a rotor and the vicinity thereof in the steam turbine of the first embodiment.
Figure 4:
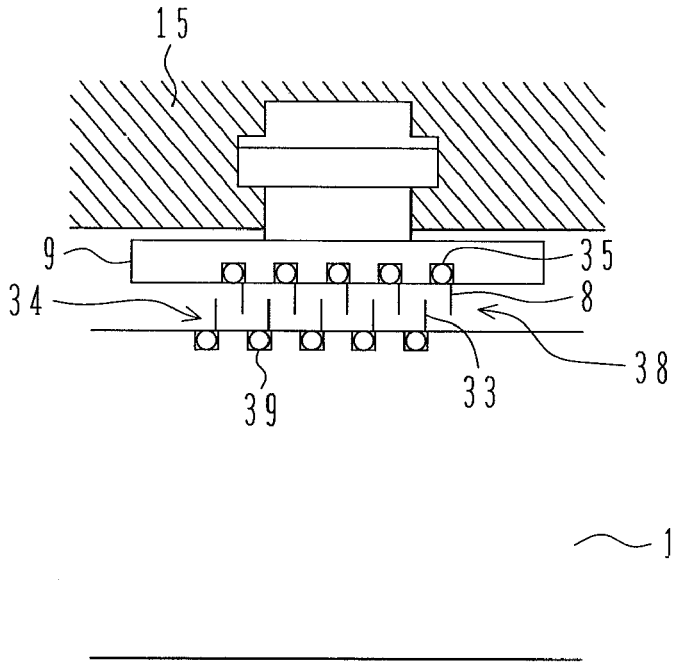
FIG. 4 is an enlarged, schematic, side view of a seal body in the steam turbine of the first embodiment.

FIG. 1 is a side view of a steam turbine according to a first embodiment of the present invention, FIG. 2 is a sectional view thereof, FIG. 3 is an enlarged diagram of a rotor and the vicinity thereof in the steam turbine shown in FIG. 1, and FIG. 4 is an enlarged, schematic side view of a seal body in the steam turbine shown in FIG. 1.

The illustrated steam turbine of the first embodiment mainly includes a rotor 1, diaphragms 2 which surround the rotor annularly from the outer periphery side of the rotor, a casing 3 which encloses the diaphragms 2 and the rotor 1, a displacement detector 4 for measuring a difference (designated "d") in thermal expansion between the casing 3 and the rotor 1, heating/cooling devices 6 attached to flanges 5 of the casing 3 to heat or cool the flanges, a controller 7 which makes control so that the flanges 5 are heated or cooled by the heating/cooling devices 6 in accordance with a measured value obtained by the displacement detector 4 in unsteady operation (start or stop of the steam turbine), and seal bodies 9 provided in gaps formed on the outer periphery side of the rotor 1, the seal bodies 9 being annularly provided facing the rotor 1 and having sealing fins 8 of a convex shape projecting toward the rotor 1.

The rotor 1 has moving blades 10 each extending annularly in the circumferential direction of the rotor and arranged axially of the rotor at predetermined intervals. The rotor 1 extends through the casing 3 in shaft sealing portions (gland portions) 11 (left side in the figure) and 12 (right side in the figure) of the casing 3 and is supported by a bearing 13 at its end on the shaft sealing portion 11 side and by a bearing 14 at its end on the shaft sealing portion 12 side.

The diaphragms 2 include inner rings 15 provided radially outwards of the rotor 1 from the rotor, stationary blades 16 provided radially outwards of the rotor 1 from the inner rings, and outer rings 17 provided radially outwards of the rotor 1 from the stationary blades 16. The stationary blades 16 are provided correspondingly to the moving blades 10 which constitute plural axial blades on the rotor 1 as described above. Each annular stationary blade constitutes a turbine stage. The stationary blades 16 make the flow of steam uniform which steam is introduced into the turbine from a steam inlet 20 (to be described later), and conduct the steam flow to the moving blades 10, thereby causing the rotor 1 to rotate.

The casing 3 is divided in plural portions. In this embodiment, the casing 3 is divided in two along the axis of the rotor 1. The casing 3 includes an upper half 18 and a lower half 19 positioned on upper and lower sides respectively when assembled. The upper half 18 and the lower half 19 are each provided with two flanges 5 as thick-walled portions projecting radially outwards of the rotor 1. The upper half 18 and the lower half 19 are clamped together with bolts or the like through the flanges 5, thus constituting the casing 3. To join both upper half 18 and lower half 19 it is necessary for the flanges 5 to have a certain thickness. Therefore, the heat capacity of the flanges 5 is large in comparison with the other portion of the casing 3, contributing greatly to an increase in heat capacity of the casing 3. The number of divided portions of the casing 3 is not limited to two. The casing 3 may be divided into a larger number of portions.

The casing 3 has a steam inlet 20 for the introduction of steam which is used to rotate the rotor 1. The steam inlet 20 is connected to a steam supply pipe 21, and a flow control valve 22 for adjusting the amount of steam is installed in the pipe 21. The flow control valve 22 is connected to the controller 7 and the degree of its opening is controlled in accordance with a control signal transmitted from the controller 7.

The displacement detector 4 is fixed to the shaft sealing portion 12 side of the casing 3 so as to face the rotor 1 and measures the difference d in thermal expansion in the rotor axis direction between the casing 3 and the rotor 1. Further, the displacement detector 4 is connected to the controller 7 and transmits measured values as detection signals continuously to the controller 7.

The heating/cooling devices 6 are attached to the flanges 5 respectively of the upper half 18 and the lower half 19 of the casing 3. A pipe 23 for the supply of a heat transfer medium, e.g., steam (water) as a working fluid to heat or cool the flanges 5, and a pipe 24 for the discharge of the heat transfer medium after heating or cooling the flanges 5, are connected to the heating/cooling devices 6. A flow control valve 25 is installed in the pipe 23. Further, a pipe 26 for the flow of a heating medium and a pipe 27 for the flow of a cooling medium are connected to an upstream side of the flow control valve 25. A flow control valve 28 for adjusting the flow rate of the heating medium is installed in the pipe 26, while a flow control valve 29 for adjusting the flow rate of the cooling medium is installed in the pipe 27. The flow control valves 25, 28 and 29 are connected to the controller 7 and their openings are each controlled in accordance with an operation signal transmitted from the controller 7.

In FIGS. 3 and 4, the seal bodies 9 each include the convex sealing fins 8 projecting toward the rotor 1, forming a concave/convex portion 38 on the surface thereof positioned on the rotor 1 side. The seal bodies 9 are disposed in gaps 30 formed between outer ends of the moving blades 10 in the radial direction of the rotor 1 and the casing 3, in gaps 31 formed between the rotor 1 and the inner rings 15 (diaphragms 2), and further in gaps (shaft sealing portions) 32 formed between the rotor 1 and the casing 3. The seal bodies 9 are annularly provided so as to surround the rotor 1 or the moving blades 10 from the outer periphery side. On the outer periphery surface of the rotor 1 there are formed concave/convex portions 34 by sealing fins 33 correspondingly to the sealing fins 8. The concave/convex portions 34 are formed for fitting with the concave/convex portions 38 formed on the seal bodies 9 in such a manner that the portions 34 and 38 do not contact each other (staggered type). According to such a configuration, the steam flowing path is formed in a zigzag fashion, so that the steam passing distance becomes longer and the amount of steam leaking from the gaps 30, 31 and 32 decreases, with consequent improvement of the turbine efficiency. The shape of the sealing fins 8 and that of the corresponding sealing fins 33 are not limited to the illustrated ones, but any other shape may be adopted insofar as the shape adopted forms concave/convex portions and makes the steam passing distance long.

Figure 5:
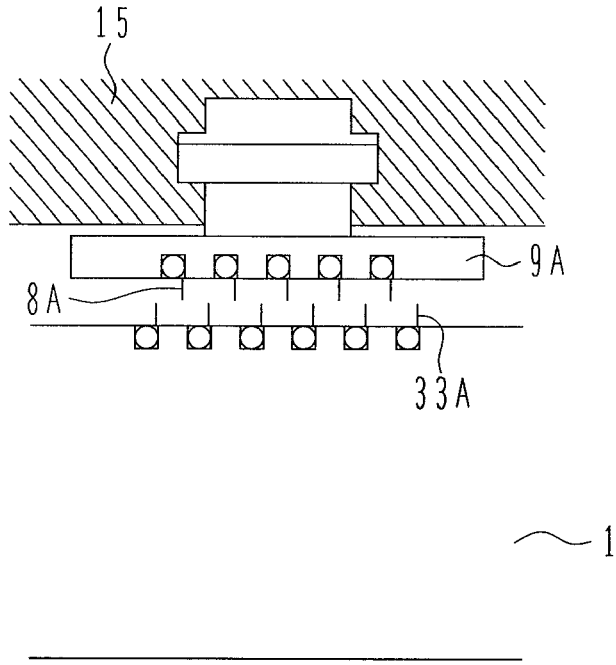
FIG. 5 is an enlarged, schematic side view of another seal body in the steam turbine of the first embodiment.

The sealing bodies 9 in this embodiment are so-called caulking seals wherein the sealing fins 8 are fixed by caulking to grooves formed in the seal bodies 9. Caulking is advantageous in that an excessive shaft vibration (rubbing vibration) caused by thermal deformation of the rotor 1 is difficult to occur because the sealing fins 8 themselves are extremely thin and superior in heat dissipating performance and that even if front ends of the sealing fins are damaged, their function as sealing elements are not markedly deteriorated, permitting easy maintenance. In this embodiment, the sealing fins 33 formed on the rotor 1 side are also fixed by caulking to grooves 39. As a substitute for the staggered type seal body 9 shown in FIG. 4 there may be used seal body 9A having such a shape as shown in FIG. 5. In the seal body 9A shown in FIG. 5, sealing fins 8A formed on the seal body 9A side and corresponding sealing fins 33A formed on the rotor 1 side are spaced a predetermined distance from each other in the radial direction of the rotor (double strip type).

As described above, the controller 7 is connected to the displacement detector 4 and the flow control valves 22, 25, 28, 29. A measured value of the difference d in thermal expansion between the casing 3 and the rotor 1 is transmitted from the displacement detector 4 to the controller 7, which in turn transmits operation signals to the flow control valves 22, 25, 28 and 29. In a so-called unsteady operation (indicating the occurrence of a difference in expansion due to a difference in heat capacity between the casing 3 and the rotor 1 caused by an abrupt change of temperature, e.g., start or stop of the steam turbine) of the steam turbine, the controller 7 determines timings for opening or closing the valves 22, 25, 28 and 29 on the basis of the measured value of the difference in expansion transmitted from the displacement detector 4, then transmits them as operation signals to the valves 22, 25, 28 and 29 to heat or cool the casing 3 in advance, thereby controlling the expansion difference d caused by the difference in heat capacity between the casing 3 and the rotor 1.

The controller 7 in this embodiment uses the expansion difference d as an index for determining the timing for opening or closing each of the valves 22, 25, 28 and 29 and stores beforehand two broadly classified types of values as preset values, as will be described below.

A first preset value L represents a timing for heating the whole of both rotor 1 and casing 3 with steam as a working fluid and it is determined taking into account the spacing between the sealing fins 8 and 33 and the expansion rate of the rotor 1. When the expansion difference d becomes the preset value L or larger, the controller 7 makes control to open the flow control valve 22 for introducing steam into the steam inlet 20, thereby heating the rotor 1 and the casing 3. The preset value L is set smaller than the spacing of the sealing fins 8 of the seal body 9 lest the sealing fins 8 and 33 should collide with each other by expansion of the casing 3.

A second preset value M represents a timing for heating the whole of both rotor 1 and casing 3 with only steam. Taking the heat capacities and expansion rates of the casing 3 and the rotor 1 into account, it is preferable to adopt a value at which the expansion rate of the casing 3 and that of the rotor 1 become substantially equal to each other by only heating with steam after stop of the heating by the heating/cooling devices 6. The controller 7 makes control so as to close the flow control valve 25 when the expansion difference d becomes the preset value M or smaller, thereby stopping the heating of the flanges 5 by the heating/cooling devices 6. The value M is set at least smaller than the preset value L.

Thus, for the preset values L and M used to start up the steam turbine when stopping the operation of the steam turbine, preset values R and S are used. The preset value R corresponds to the preset value L and represents a timing for stopping the introduction of steam and cooling both rotor 1 and casing 3. It is determined taking into account the spacing of the sealing fins 8 and 33 and the expansion rate of the rotor 1. The preset value S corresponds to the preset value M and represents a timing for cooling both rotor 1 and casing 3 by only natural cooling. As the value S it is preferable to adopt a value at which the expansion rate of the casing 3 and that of the rotor 1 become approximately equal to each other even by only natural cooling after the stop of cooling by the heating/cooling devices 6. Although detailed explanations of the present values R and S are omitted to avoid duplications, they have substantially the same properties as the preset values L and M.

Now, with reference to FIG. 6, a description will be given about a control procedure for the steam turbine by the controller 7.

Figure 6A:
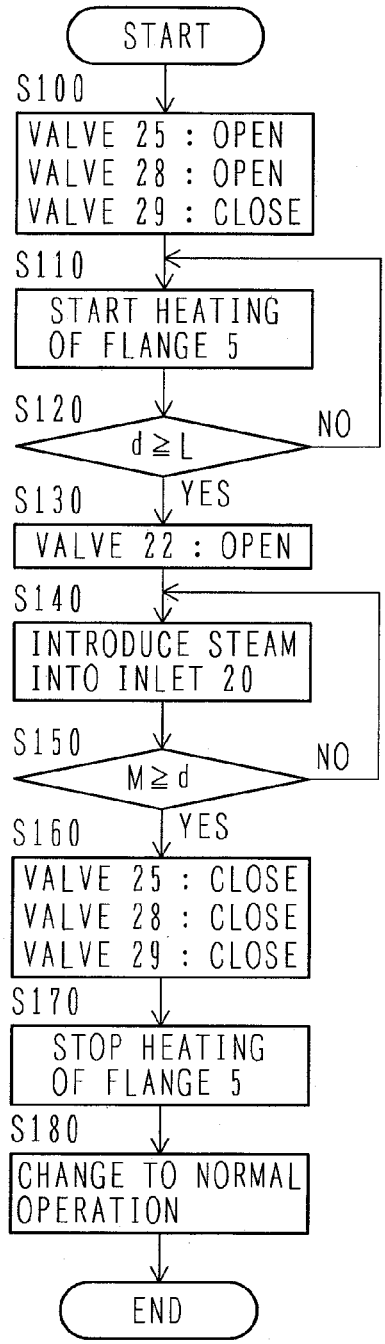
FIG. 6 is a flow chart showing the contents of processes performed by a controller 7 at the time of start and stop of the steam turbine of the first embodiment.
Figure 6B:
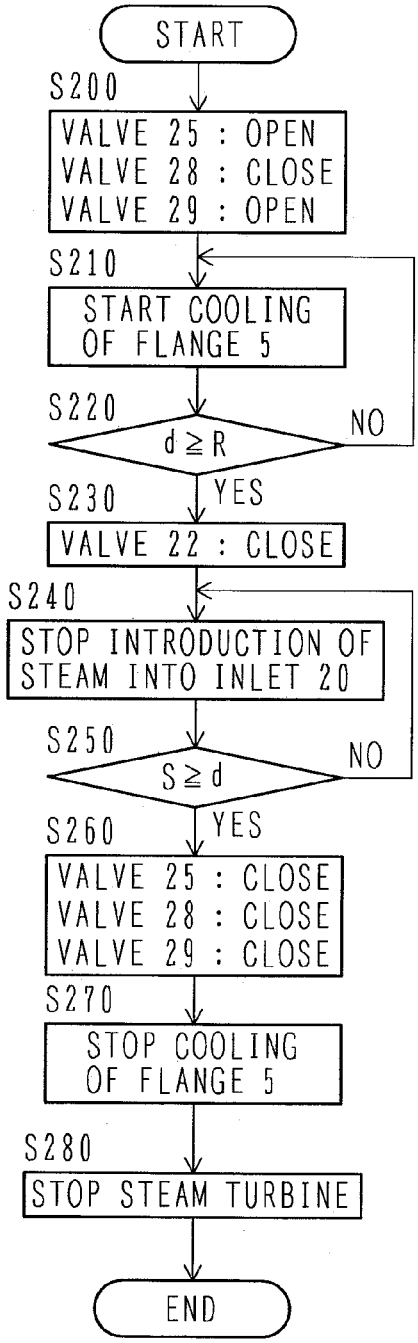

FIG. 6A is a flow chart showing the contents of processes performed by the controller 7 at the time of start-up of the steam turbine and FIG. 6B is a flow chart showing the contents of processes performed by the controller 7 at the time of stop of the steam turbine.

To start up the steam turbine, as shown in FIG. 6A, the controller 7 first opens the flow control valve 28 and closes the flow control valve 29 to introduce the heating medium to the flow control valve 25, further, opens the flow control valve 25 to introduce the heating medium to the heating/cooling device 6 (S100). As a result, the flanges 5 are heated by the heating/cooling devices 6 and the casing 3 begins to expand with the heat (S110).

Next, when a predetermined time has elapsed and it is detected that the expansion difference d reaches the present value L or larger (S120), the controller 7 opens the flow control valve 22 (S130) to introduce steam into the steam inlet 20 (S140). With this steam, both casing 3 and rotor 1 are heated and the rotor 1, which is small in heat capacity than the casing 3, easily expands thermally, so that the expansion difference d gradually becomes smaller from near the L value.

Next, when a predetermined time has elapsed and it is detected that the expansion difference d reaches the preset value M or smaller (S150), the controller 7 closes the flow control valves 25 and 28 to stop the supply of the heating medium to the heating/cooling devices 6 (S160). As a result, the heating of the flanges 5 by the heating/cooling devices 6 is stopped (S170) and the casing 3 is heated by only steam together with the rotor 1. Thereafter, with the heat of the steam, the expansion difference between the casing 3 and the rotor 1 becomes smaller gradually and eventually reaches nearly zero, so that the operation of the steam turbine shifts as it is to the steady operation (S180). Controlling the steam turbine in the above manner is advantageous in that, by heating the flanges 5 of the casing 3 large in heat capacity beforehand, the maximum value of the expansion difference d can be made extremely small and hence the time required at the time of starting up the steam turbine can be greatly shortened.

On the other hand, to stop the operation of the steam turbine, as shown in FIG. 6B, the controller 7 first opens the flow control valve 29 and closes the flow control valve 28 to introduce the cooling medium to the flow control valve 25, further, opens the flow control valve 25 to conduct the cooling medium to the heating/cooling devices 6 (S200). As a result, the flanges 5 are cooled by the heating/cooling devices 6 and the casing 3 begins to shorten with the chillness (S210).

Next, when a predetermined time has elapsed and it is detected that the expansion difference d reaches the preset value R or larger (S220), the controller 7 closes the flow control valve 22 (S230) to stop of the supply to steam to the steam inlet 20 (S240). As a result, both casing 3 and rotor 1 are cooled and the expansion difference d becomes smaller gradually because the rotor 1 smaller in heat capacity than the casing 3 shortens more easily.

Then, when a predetermined time has elapsed and it is detected that the expansion difference d reaches the preset value S or smaller (S250), the controller 7 closes the flow control valves 25 and 29 to stop the supply of the heating medium to the heating/cooling devices 6 (S260). As a result, the cooling of the flanges 5 by the heating/cooling devices 6 is stopped (S270) and the casing 3 is cooled naturally together with the rotor 1. Thereafter, the expansion difference d between the casing 3 and the rotor 1 becomes smaller gradually and eventually reaches zero, whereby the operation of the steam turbine can be stopped as it is (S280). Controlling the steam turbine in the above manner is advantageous in that the time required for stopping the operation of the steam turbine can be greatly shortened because the maximum value of the expansion difference d can be made extremely small by precooling the flanges 5 of the casing 3 large in heat capacity.

Figure 7:
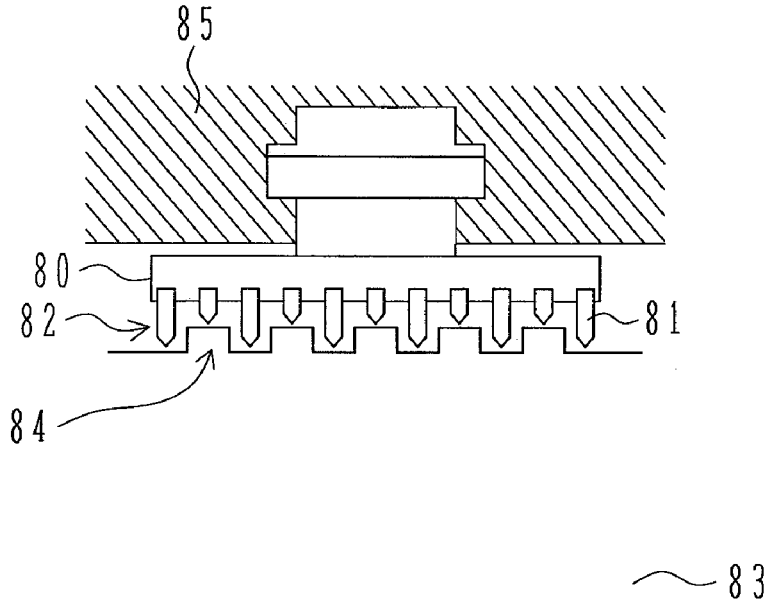
FIG. 7 is an enlarged, schematic side view of a conventional seal body in a steam turbine shown as an example of comparison with the first embodiment.

Effects of this embodiment will be described below with reference to FIG. 7, which is a side view showing the structure of a labyrinth seal.

In an ordinary type of a steam turbine, between a rotor (rotating part) adapted to rotate at high speed and a stationary part such as a casing which covers the rotor from the outside there is formed a gap for preventing contact between the rotor and the stationary part. However, the steam for rotating the rotor leaks from the said gap, resulting in deterioration of the turbine efficiency. As means for suppressing such steam leakage there is known the provision of a sealing device. As an example of such a sealing device there is known a sealing device wherein, as shown in FIG. 7, a concave/convex portion 82 formed by sealing fins 81 on a seal body 80 and a concave/convex portion 84 formed on a rotor 83 side fit together without mutual contact, thereby decreasing the leakage of steam in the aforesaid gap. Such a sealing device is called a labyrinth seal.

In case of using such a labyrinth seal and when starting or stopping the operation of the steam turbine, it is necessary to pay attention to the difference in expansion caused by the heat of a member which constitutes the steam turbine. In the case of the above labyrinth seal, the rotor 83 smaller in heat capacity than a casing 85 expands more easily than the casing 85 upon heating, so that the concave/convex portion 82 of the seal body 80 and the concave/convex portion 84 of the rotor 83 come into contact with each other due to the occurrence of an expansion difference between the casing 85 and the rotor 83. As a result, there may occur a shaft vibration (rubbing vibration). Excessive rubbing vibration can cause even a situation such that the operation of the steam turbine must be stopped.

As a technique for shortening the time required for unsteady operation and thereby improving the turbine efficiency while controlling the difference in expansion between the rotor and the casing there is known a technique wherein a heat transfer medium flowing passage is attached to the outer periphery surface of the casing which is larger in heat capacity than the rotor. This technique premises warming-up or cooling of the entire casing. In other words, if it is impossible to provide a sufficient amount of steam necessary for warming-up or cooling of the casing, the said technique is less effective and may involve difficulty in its practical application.

In this connection, according to this embodiment, the heating/cooling devices 6 are attached to the flanges 5 which are thick-walled portions for joining the upper half 18 and the lower half 19 of the casing 3 and which greatly contribute to the heat capacity of the casing 3, and the time for heating or cooling the flanges 5 on the basis of the expansion difference d detected by the displacement detector 4 is controlled by the controller 7. Consequently, the flanges 5 larger in heat capacity than the other portion of the casing 3 are heated or cooled preferentially and the remaining portion can be heated or cooled with steam or the like together with the rotor 1. Thus, the amount of heat transfer medium and that of energy used can be decreased in comparison with the case of heating or cooling the entire casing in advance. Moreover, since the maximum value of the expansion difference d between the rotor 1 and the casing 3 can be made extremely small, it is possible to prevent deformation or breakage caused by contact between the sealing fins 8 and the sealing fins 33. Further, since the sealing fin spacing can be narrowed as a result of the maximum value of the expansion difference d becoming small, it is possible to increase the number of sealing fins 8 for each seal body 9 and hence possible to enhance the steam leakage suppressing function of the seal body 9. According to this embodiment, since the leakage of steam during operation of the turbine can be suppressed while shortening the time required for unsteady operation, whereby it is possible to improve the efficiency of the steam turbine.

Although the pipe 23 alone is used as a system for the supply of heat transfer media to the heating/cooling devices attached respectively to the upper half 18 and the lower half 19 of the casing, independent pipes may be connected to the heating/cooling devices 6 respectively. According to this configuration, for example even in the case where a temperature difference occurs between the upper and lower halves 18, 19, the temperature difference can be compensated by introducing heat transfer media of different temperatures into the heating/cooling devices 6. Moreover, when it is necessary to control heating or cooling of the casing 3 in the axial direction of the rotor 1 (for example when there occurs a temperature difference in the axial direction of the rotor 1), divided heating/cooling devices 6 suitably divided in the rotor axis direction may be attached to the flanges 5 and may be controlled each independently.

Although in the above embodiment the heating/cooling devices 6 using fluid as a heat source are adopted as means for heating and cooling the flanges 5, means for heating and cooling the flanges 5 are not limited thereto. The following description is now provided about a modification of this embodiment which modification utilizes other means than the heating/cooling devices 6.

Figure 8:
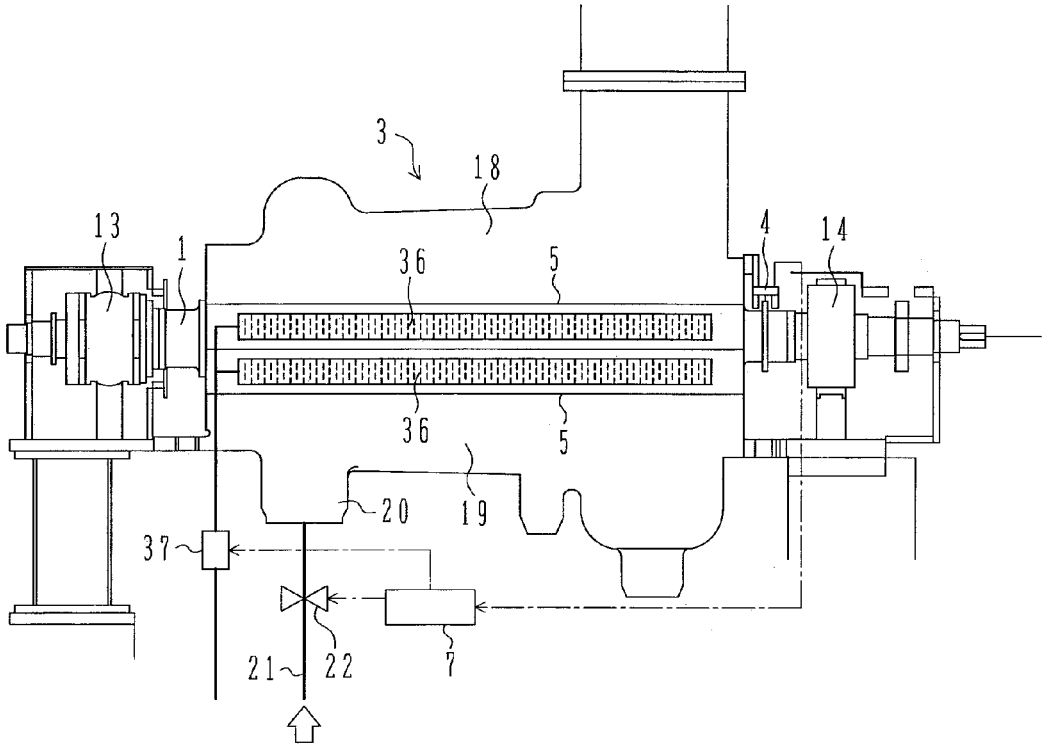
FIG. 8 is a side view of a steam turbine according to a modification of the first embodiment.

FIG. 8 is a side view of a steam turbine according to a modification of the first embodiment.

The steam turbine illustrated in FIG. 8 includes heater/cooler devices 36 for heating and cooling the flanges 5 electrically as a substitute for the heating/cooling devices 6 used in the steam turbine of the first embodiment, as well as a power supply unit 37 for the supply of electric power to the heater/cooler devices 36. The same portions as in the first embodiment are identified by the same reference numerals as in the first embodiment and explanations thereof will be omitted. Also by thus constituting the steam turbine with use of the heating/cooling means (heater/cooler devices 36) which operate by electric power, it is possible to obtain substantially the same effects as in the first embodiment. Particularly, by using such heater/cooler devices 36 as in this modification, it is possible to conduct a temperature control which is a more delicate control than the control utilizing fluid as a heat transfer medium. Consequently, there is obtained an outstanding effect that the expansion difference d can be controlled more accurately. It goes without saying that also in this case the heater/cooler devices 36 may be configured so as to be capable of being controlled each independently as is the case with the heating/cooling devices 6.

A second embodiment of the present invention will be described below.

A main feature of this second embodiment resides in that heating or cooling of the flanges 5 of the casing 3 is started after moving the seal bodies radially outwards of the rotor 1 and the seal bodies are moved back to their original positions after stop of the cooling or heating, thereby eliminating the problem caused by a thermal expansion difference.

Figure 9:
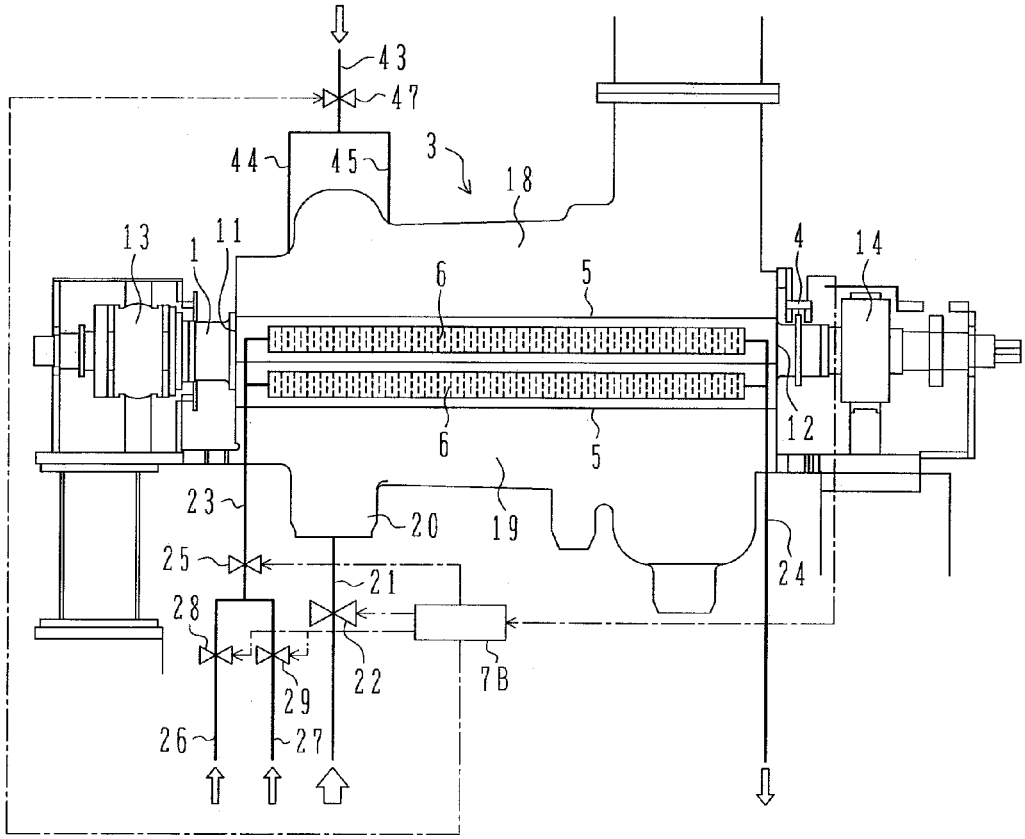
FIG. 9 is a side view of a steam turbine according to a second embodiment of the present invention.
Figure 10:
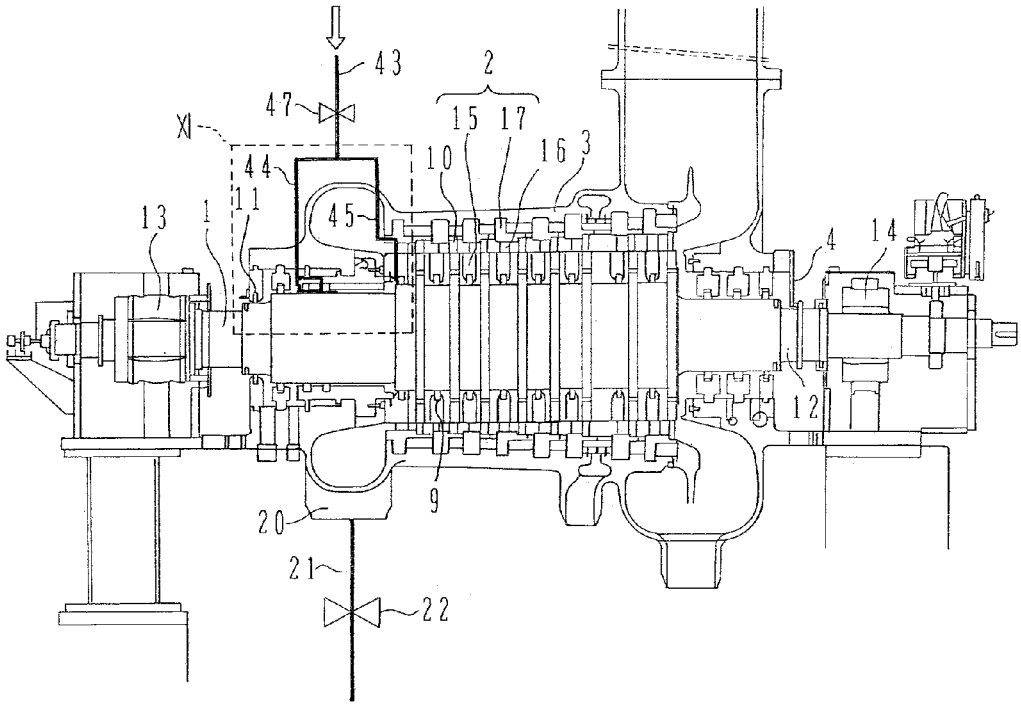
FIG. 10 is a sectional view thereof.
Figure 11A:
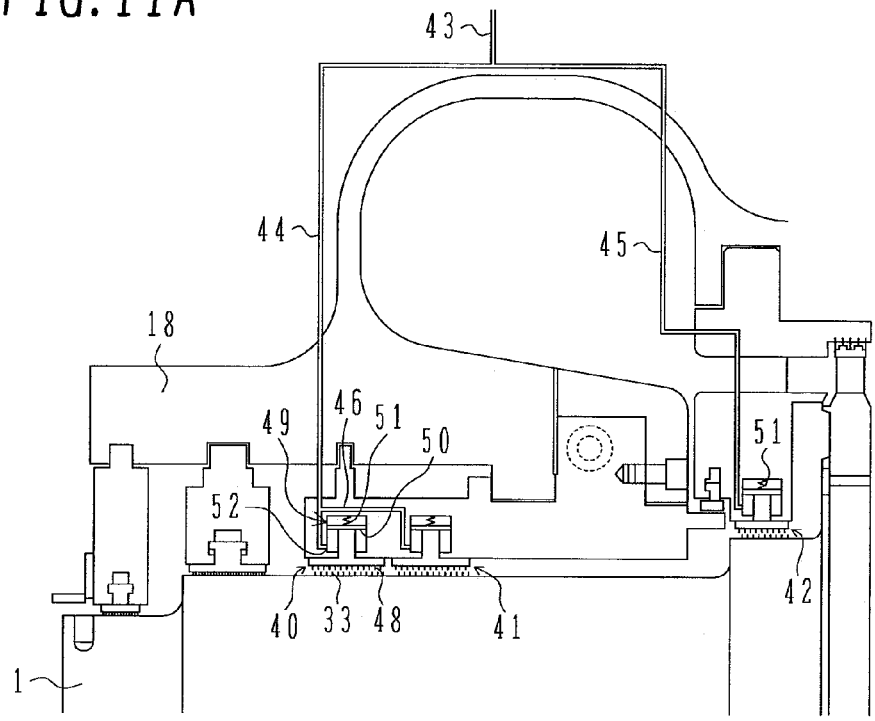
FIG. 11 is an enlarged diagram of a portion XI in FIG. 10.
Figure 11B:
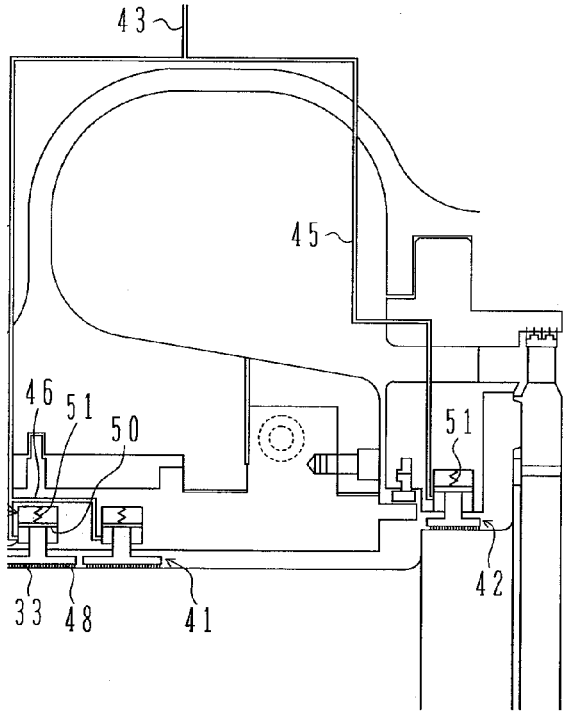

FIG. 9 is a side view of a steam turbine according to a second embodiment of the present invention and FIG. 10 is a sectional view thereof. FIGS. 11A and 11B are enlarged views of a portion XI indicated with a dotted line in FIG. 10, of which FIG. 11A shows a state in which seal bodies have been moved radially outwards of the rotor and FIG. 11B shows a state in which the seal bodies are in neutral positions. The same portions as in the previous drawings are identified by the same reference numerals as in the previous drawings and explanations thereof will be omitted.

The illustrated steam turbine of this second embodiment mainly includes, as components different from those of the steam turbine of the first embodiment, seal bodies 40, 41 and 42 for suppressing the leakage of steam from gaps formed on the outer periphery side of the rotor 1, a steam main pipe 43 for introducing steam (steam for seal bodies) which is used for retracting the seal bodies 40, 41 and 42 radially outwards of the rotor 1, steam sub-pipes 44, 45 and 46 for supplying the steam introduced from the main pipe 43 to the seal bodies 40, 41 and 42, a flow control valve 47 for adjusting the flow rate of steam to be supplied to the steam sub-pipes 43, 44 and 45, and a controller 7B which controls the operation of the seal bodies 40, 41, 42 and heating and cooling of the flanges 5 by the heating/cooling devices 6 on the basis of the expansion difference d.

The seal body 40 includes convex sealing fins 48 provided in a gap formed on the outer periphery side of the rotor 1, the sealing fins 48 being annularly formed facing the rotor and projecting toward the rotor 1, a pressure working surface 50 which upon receipt of pressure from the steam for seal bodies causes the seal body 40 to move radially outwards of the rotor 1 from a neutral position thereof (to be described later), a spring member (resilient member) 51 which presses the seal body 40 radially inwards of the rotor 1 when the seal body 40 is moved radially outwards of the rotor 1 from its neutral position, and a steam supply port 52 formed in a side face of a recess 49 and connected to the steam sub-pipe 44 to supply the sealing steam into the recess 49.

The seal body 40 is a so-called staggered type and is configured in such a manner that in its neutral position (the state shown in FIG. 11B) in which it is located when the sealing steam is not supplied to the recess 49, the concave/convex portion formed by the sealing fins 33 on the rotor 1 side and the concave/convex portion formed by the sealing fins 48 fit together without mutual contact. As to the seal bodies 41 and 42, explanations thereof will be omitted because they are of the same configuration as the seal body 40.

On a downstream side of the flow control valve 47 the steam main pipe 43 branches to the steam sub-pipes 44 and 45. The steam sub-pipe 44, further downstream thereof, branches to the steam sub-pipe 46. The steam sub-pipes 44, 45 and 46 are connected respectively to steam supply ports 52 formed in the recesses 49 in which the pressure working surfaces 50 of the seal bodies 40, 42 and 41 are accommodated, and supply steam to the recesses 49. The steam supplied to each recess 49 acts on the pressure working surface 50, causing the seal body 40 to retract radially outwards of the rotor 1 and causing the seal body 40 which receives a reaction force from the spring member 51 to stop at a predetermined position.

The controller 7B is connected to the displacement detector 4 and the flow control valves 22, 25, 28, 29, 47. A measured value of the expansion difference d is transmitted from the displacement detector 4 to the controller 7B, which in turn transmits operation signals to the flow control valves 22, 25, 28, 29 and 47. With the operation signals, as is the case with the controller 7, the controller 7B heats or cools the casing 3 in advance an controls the expansion difference caused by the difference in heat capacity. At the same time, the controller 7B opens or closes the valve 47 and controls the movement of the seal bodies 40, 41 and 42 in the radial direction of the rotor 1.

As in the first embodiment, the controller 7B in this embodiment also uses the expansion difference d as an index for determining the timing for opening or closing each of the valves 22, 25, 28, 29 and 47 and, as preset values to be stored in advance, it stores preset values N and T which are a third type of preset values, in addition to the two types of preset values (L, R and M, S) used in the first embodiment. The preset value N is used at the time of starting up the steam turbine, while the present value T is used at the time of stopping the operation of the steam turbine.

The preset values N and T represent respectively a timing at which as a result of termination of the thermal expansion of the rotor 1 and the casing 3 the operation of the steam turbine can be shifted to the steady operation and a timing at which the operation of the steam turbine can be stopped. These timings are determined taking into account the timing at which the expansion rate of the rotor 1 and that of the casing 3 become approximately equal to each other as a result of heating and cooling. When the expansion difference d reaches the preset value N or T or smaller, the controller 7B closes the flow control valve 47 to stop the supply of steam to the steam sub-pipes and causes the seal bodies 40, 41 and 42 (to be described later) to move to their neutral positions, seal bodies having been retracted radially outwards of the rotor 1 at the time of starting heating or cooling of the flanges 5. The preset values N and T are set smaller than the preset values M and S, respectively.

Now, with reference to FIG. 12, a control procedure for the steam turbine by the controller 7B will be described.

Figure 12A:
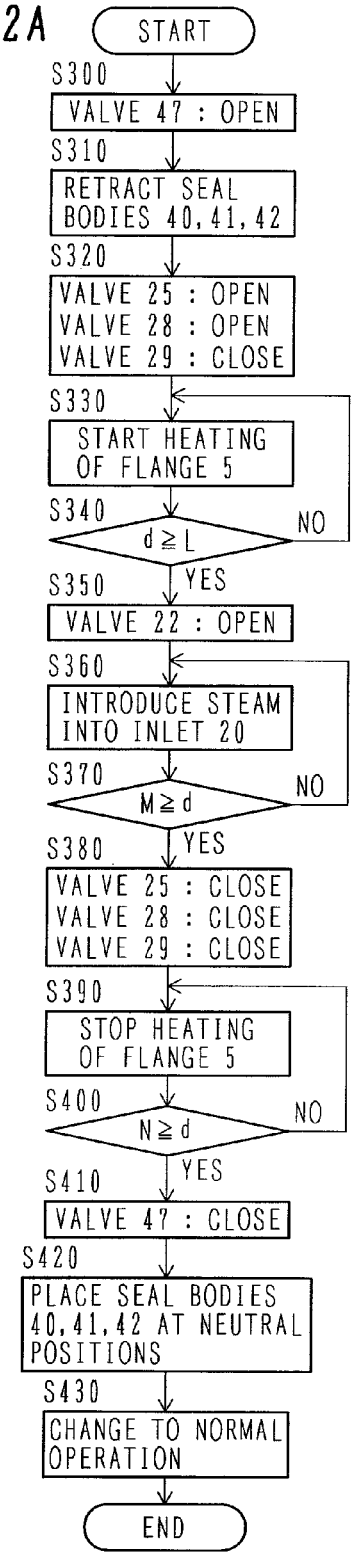
FIG. 12 is a flow chart showing the contents of processes performed by a controller 7B at the time of start and stop of the steam turbine of the second embodiment.
Figure 12B:
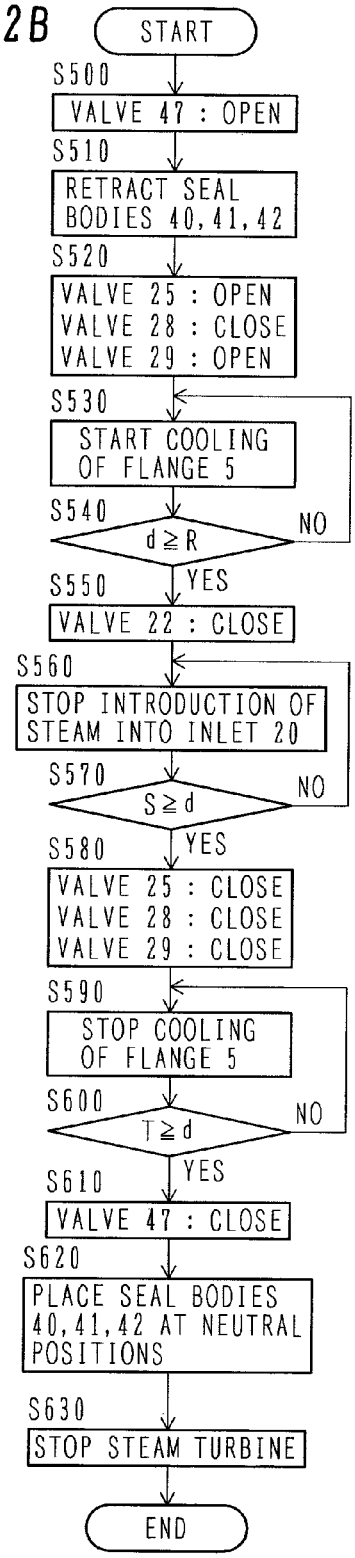

FIG. 12A is a flow chart showing the contents of processes performed by the controller 7B at the time of starting up the steam turbine and FIG. 12B is a flow chart showing the contents of processes performed by the controller 7B at the time of stopping the operation of the steam turbine.

To start up the steam turbine, as shown in FIG. 12A, the controller 7B first opens the flow control valve 47 to supply steam for seal bodies to the steam sub-pipes 44, 45 and 46 (S300). The steam thus supplied flows through the steam sub-pipes 44, 45 and 46 and acts on the pressure working surfaces 50 of the seal bodies 40, 41 and 42, causing the seal bodies 40, 41 and 42 to be retracted radially outwards of the rotor 1 (S310).

After the retraction of the seal bodies 40, 41 and 42, the controller 7B performs the same processes as those which the controller 7 has performed in steps S100 to S170 in the first embodiment and stops heating of the flanges 5 (S320 to S390). Consequently, the casing 3, together with the rotor 1, is heated with only the steam introduced from the steam inlet 20 and the expansion difference d becomes smaller than the preset value M.

When a predetermined time has elapsed and it is detected that the expansion difference d reaches the preset value N or smaller (S400), the controller 7B closes the flow control valve 47 (S410) and causes the seal bodies 40, 41 and 42 to move back to their neutral positions (S420). Thereafter, with the heat of the steam, the expansion difference d between the casing 3 and the rotor 1 becomes smaller gradually and eventually becomes approximately zero, so that the operation of the steam turbine shifts to its steady operation (S430).

Also, to stop the operation of the steam turbine, as shown in FIG. 12B, the seal bodies 40, 41 and 42 are retracted radially outwards of the rotor 1 by the controller 7B and cooling of the casing 3 and rotor 1 is started in the same manner as above. When the expansion difference d has become the preset value T or smaller after going through predetermined steps, the flow control valve 47 is closed, the seal bodies 40, 41 and 42 are returned to their neutral positions, and the operation of the steam turbine is stopped (S500 to S630).

By controlling the steam turbine in the manner described above there are obtained the following effects in addition to the effects described in the first embodiment. The sealing bodies 40, 41 and 42 can be retracted in unsteady operation in which there is a possibility of mutual contact of the sealing fins 48 and 33, and thus damage, etc. caused by mutual contact of the sealing fins 48 and 33 can be surely avoided, whereby it is possible to improve the reliability of the steam turbine. Moreover, even with use of staggered type seal bodies wherein the sealing fins 48 and 33 fit together and exhibit an excellent steam leakage suppressing function, mutual contact of the sealing fins 48 and 33 in unsteady operation can be surely avoided and therefore it becomes unnecessary to take into account the expansion difference between the casing 3 and the rotor 1 in unsteady operation. Consequently, the spacing of the sealing fins 48 can be made smaller than in the first embodiment and the amount of steam leakage in steady operation can be suppressed more effectively. According to this embodiment, since it is possible to shorten the time required for unsteady operation and further suppress the leakage of steam in steady operation, the turbine efficiency can be improved in a series of operations from the start to stop of the steam turbine.

In this embodiment, for the simplification of explanation, reference has been made to the seal body 42 disposed in a gap 31 formed between the rotor 1 and an inner ring 15 and the seal bodies 40 and 41 disposed in a gap 32 formed between the rotor 1 and the casing 3, as seal bodies capable of moving forward and backward radially of the rotor 1. However, seal bodies of the same configuration may be provided also in gaps 30 formed between front ends of the moving blades 10 and the casing 3. That is, the above description does not limit the seal body mounting places.

Although no special reference has been made above to a supply source of the steam (steam for seal bodies) used for retracting the seal bodies 40, 41 and 42 radially outwards of the rotor 1, there may be adopted a method wherein the steam is obtained from the working fluid or a method wherein it is obtained from a system different from the system of the working fluid. The former method is advantageous in that the turbine efficiency is improved by utilizing the working fluid and the latter method is advantageous in that the steam pressure for moving the seal bodies can be reliably ensured.

A third embodiment of the present invention will be described below.

This third embodiment is the same as the first embodiment in that the expansion difference d is controlled by the controller 7B without retracting seal bodies radially outwards of the rotor 1. In this connection, this third embodiment is characteristic in that when sealing fins are likely to contact one another, the steam turbine is controlled so as to minimize the time required for retracting the seal bodies radially outwards of the rotor 1. A mechanical structure of the steam turbine of this embodiment is the same as that of the second embodiment and therefore explanations of its constituent elements will be omitted.

The controller 7B used in this embodiment, as in the second embodiment, also uses the expansion difference d as an index to determine the timing for opening or closing each of the valves 22, 25, 28, 29 and 47 and, as preset values to be stored in advance, it stores a preset value Z which is the fourth type of a preset value, in addition to the three type of preset values (L, R; M, S; N, T) used in the second embodiment.

The preset value Z is for preventing the occurrence of shaft vibration or the like as a result of contact of the seal bodies 40, 41 and 42 with another member (e.g., sealing fins 33). It is determined so as to avoid mutual contact of the sealing fins 48 and 33 due to thermal expansion. When the expansion difference d reaches the preset value Z or larger, the controller 7B opens the flow control valve 47 and causes the seal bodies 40, 41 and 42 to be retracted to radially outwards of the rotor 1. The preset value Z is set larger than the preset values L and R.

Now, with reference to FIG. 13, a description will be given below about a control procedure for the steam turbine performed by the controller 7B in this embodiment.

Figure 13A:
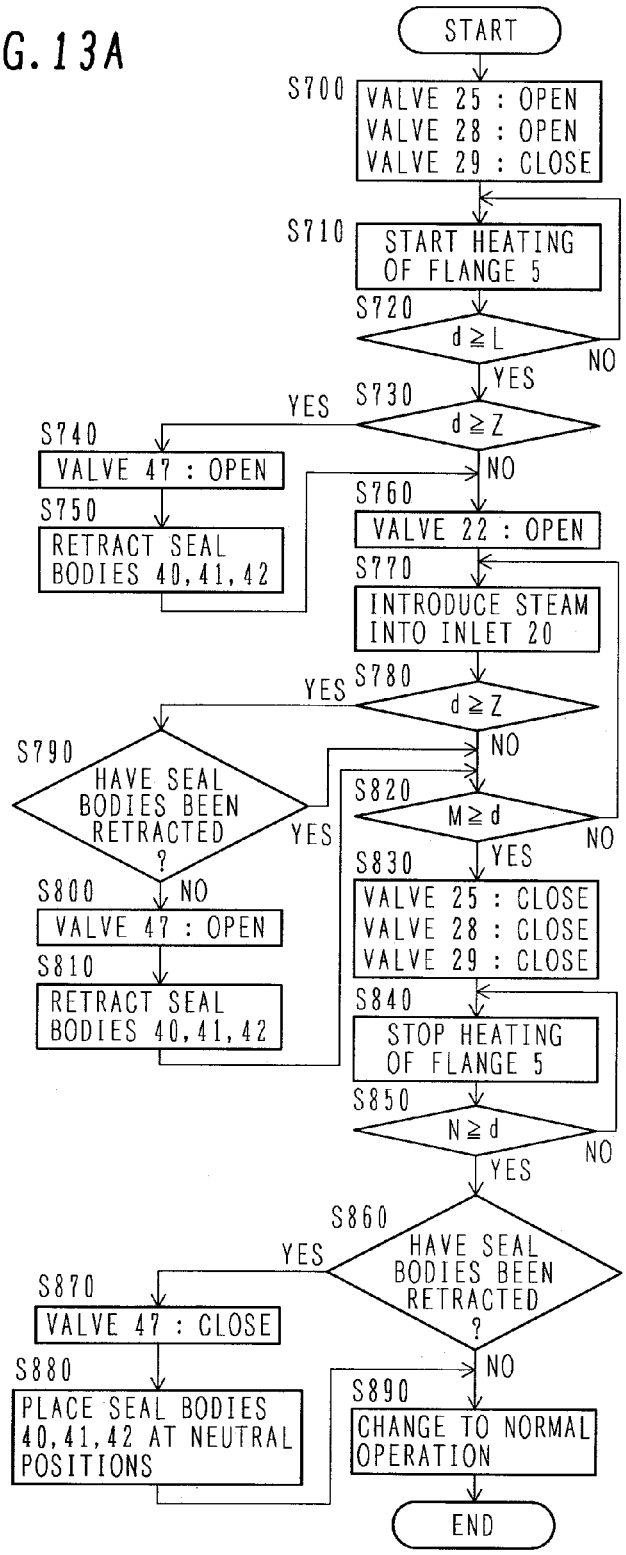
FIG. 13 is a flow chart showing the contents of processes performed by a controller 7B at the time of start and stop of a steam turbine according to a third embodiment of the present invention.
Figure 13B:
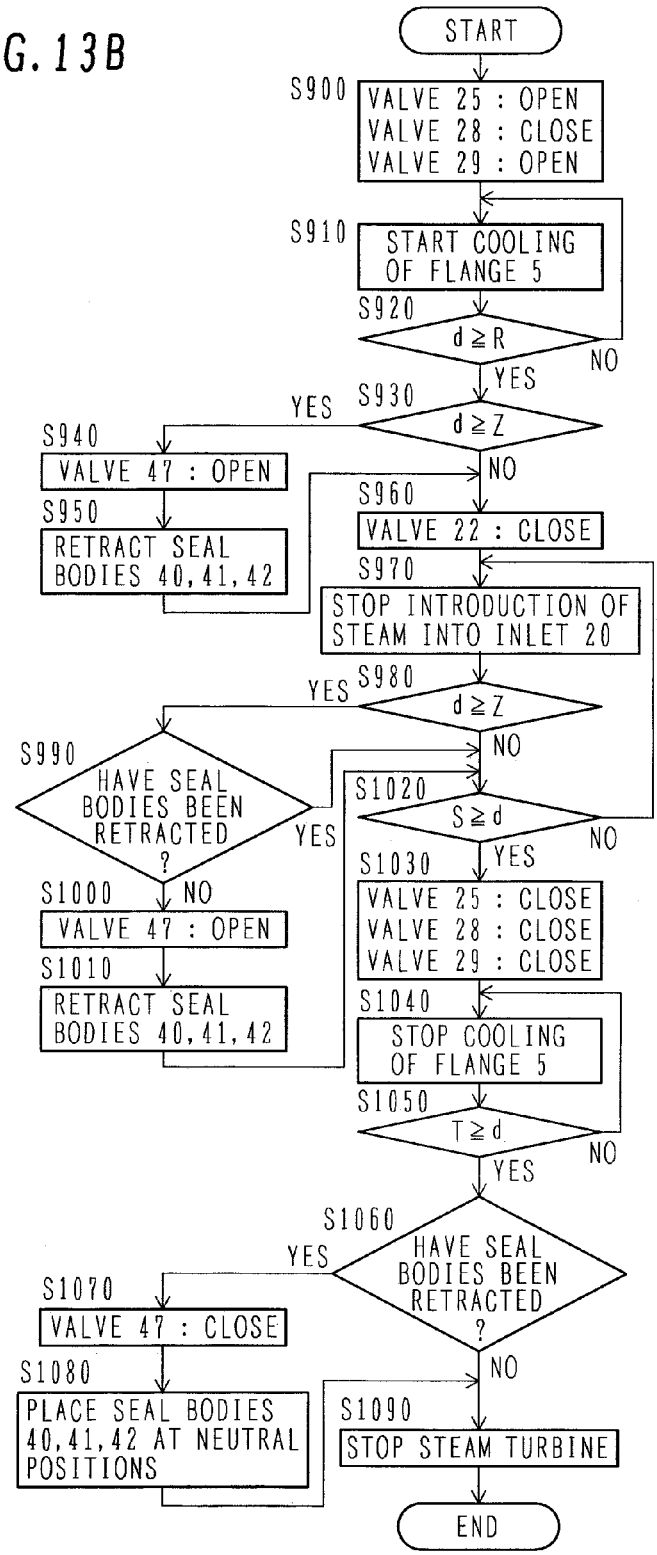

FIG. 13A is a flow chart showing the contents of processes performed by the controller 7B at the time of starting up the steam turbine and FIG. 13B is a flow chart showing the contents of processes performed by the controller 7B at the time of stopping the operation of the steam turbine.

To start up the steam turbine, as shown in FIG. 13A, the controller 7B first opens the flow control valve 28 and closes the flow control valve 29 to introduce the heating medium to the flow control valve 25, and further opens the flow control valve 25 to introduce the heating medium to the heating/cooling devices 6 (S700). As a result, the flanges 5 are heated by the heating/cooling devices 6 and the casing 3 begins to expand with the heat (S710).

Next, after a predetermined time has elapsed and after it is determined that the expansion difference d reaches the preset value L or larger (S720), it is also checked whether the expansion difference d is likely to reach the preset value Z or larger (S730). If the expansion difference d is likely to reach the preset value Z or larger, it is determined that there is a possibility of mutual contact of the sealing fins 48 and 33 and the controller 7B opens the flow control valve 47 (S740) to retract the seal bodies 40, 41 and 42 radially outwards of the rotor 1 (S750).

After it is determined that the expansion difference d is smaller than the preset value Z in S730 or after retraction of the seal bodies in S750, the controller 7B opens the flow control valve 22 (S760) to introduce steam to the steam inlet 20 (S770). With this steam, both casing 3 and rotor 1 begin to be heated, but it is checked whether the expansion difference d is likely to reach the preset value Z or larger even after termination of this processing (S780). If the expansion difference d has reached the preset value Z, it is determined whether the seal bodies 40, 41 and 42 have already retracted in S750 (S790). Thereafter, as in S740 and S750, the seal bodies 40, 41 and 42 are retracted (S800 and S810).

After it is determined in S780 that the expansion difference d is smaller than the preset value Z, or after it is determined in S790 that the seal bodies 40, 41 and 42 have already been retracted, or after the seal bodies 40, 41 and 42 are retracted in S810, it is determined whether the expansion difference d has become the preset value M or smaller with the steam introduced into the steam inlet 20 and by heating of the flanges 5 (S820). When the expansion difference d has become he preset value M or smaller, the controller 7B closes the flow control valves 25 and 28 (S830) to stop heating of the flanges 5 (S840). As a result, both casing 3 and rotor 1 are heated with only the steam introduced from the steam inlet 20 and the expansion difference d becomes still smaller than the preset value M.

Next, when a predetermined time has elapsed and it is detected that the expansion difference d becomes the preset value N or smaller (S850), it is determined whether the seal bodies 40, 41 and 42 have already been retracted radially outwards of the rotor 1 (for example, it is determined whether the flow control valve 47 is open or not) (S860). If it is determined that the seal bodies 40, 41 and 42 have already been retracted, the controller 7B closes the flow control valve 47 (S870) and moves the seal bodes 40, 41 and 42 to their neutral positions (S880).

After it is determined in S860 that the seal bodies 40, 41 and 42 are in their neutral positions or after the seal bodies 40, 41 and 42 are returned to their neutral positions in S880, the expansion difference d between the casing 3 and the rotor 1 becomes smaller gradually and eventually becomes approximately zero and the operation of the steam turbine shifts to the steady operation (S890).

Also, to stop the operation of the steam turbine, as shown in FIG. 13B, the casing 3 and the rotor 1 are cooled based on the control made in the first embodiment, then during the period after the expansion difference d reaches the preset value R or larger (S920) and until it becomes the preset value S or smaller (S1020), it is determined whether there will occur a case where the expansion difference d exceeds the preset value Z, and on the basis of the determination the controller 7B controls the seal bodies 40, 41 and 42 so as to avoid mutual contact of the sealing fins 48 and 33 (S900 to S1040). Thereafter, when the expansion difference d becomes the preset value T or smaller (S1050), it is determined whether the seal bodies 40, 41 and 42 are in a retracted state radially outwards of the rotor 1 (S1060), then, if necessary, the controller 7B causes the seal bodies 40, 41 and 42 to move back to their neutral positions (S1070 and S1080) and turns OFF the steam turbine (S1090).

By controlling the steam turbine in the above manner, the time for maintaining the seal bodies 40, 41 and 42 at their neutral positions becomes longer than in the second embodiment, so that the amount of steam leakage can be further decreased and the turbine efficiency can be further improved in a series of operations from the start to stop of the steam turbine.

In the above description the process of determining whether the expansion difference d will become the preset value Z or larger is performed in only S730 and S780 in FIG. 13A or in S930 and S980 in FIG. 13B, but no limitation is made thereto. Control may be made so as to always monitor whether the expansion difference d will become the preset value Z or larger in unsteady operation. By making such a control it is possible to prevent damage of the sealing fins 33 and 48 even in the case where the expansion difference d becomes large due to an unforeseen event such as a sudden accident.

What is claimed is:

1. A steam turbine comprising:

a rotor with moving blades attached thereto;

diaphragms which surround said rotor from an outer periphery side of the rotor;

a casing which encloses said diaphragms and said rotor, said casing comprising an upper half and a lower half clamped together through respective flanges;

measuring means for measuring a difference in thermal expansion in the rotor axis direction between said casing and said rotor;

heating/cooling means attached to said flanges respectively to heat and cool the flanges; and a controller which makes control so that said flanges are heated or cooled by said heating/cooling means until a measured value obtained by said measuring means reaches a preset value in an unsteady operation, said preset value representing a timing for heating or cooling said rotor and said casing with only steam.

2. The steam turbine of claim 1, wherein said heating/cooling means uses a working fluid as a heat transfer medium to heat or cool said flanges.

3. The steam turbine of claim 1, wherein said heating/cooling means is a heater/cooler device that is operated by electric power.

4. A steam turbine comprising:

a rotor with moving blades attached thereto;

diaphragms which surround said rotor from an outer periphery side of the rotor;

a casing which encloses said diaphragms and said rotor, said casing comprising an upper half and a lower half clamped together through respective flanges;

measuring means for measuring a difference in thermal expansion in the rotor axis direction between said casing and said rotor;

heating/cooling means attached to said flanges respectively to heat and cool the flanges;

a seal body disposed in a gap formed on the outer periphery side of said rotor, said seal body being annularly disposed facing said rotor and having a convex portion projecting toward the rotor;

a seal body driving unit for moving said seal body radially outwards of said rotor from a neutral position of the seal body; and a controller which makes control so that said flanges are heated or cooled by said heating/cooling means until a measured value obtained by said measuring means reaches a preset value in unsteady operation and so that the seal body is retracted radially outwards of said rotor by said seal body driving unit when said measured value reaches another preset value for preventing contact of the convex portion of said seal body with another member, the former preset value representing a timing for heating or cooling said rotor and said casing with only steam.

5. The steam turbine of claim 4, wherein a concave/convex portion corresponding to another concave/convex portion formed by the convex portion of said seal body is formed on the outer periphery surface of said rotor.

6. The steam turbine of claim 5, wherein said concave/convex portion formed by the convex portion of said seal body is formed so as to be fitted with said another concave/convex portion formed on the outer periphery surface of said rotor without mutual contact.

7. The steam turbine of claim 4, wherein said seal body is provided at at least one of spaces between an outer end of any of said moving blades in the radial direction of said rotor and said casing, between said rotor and any of said diaphragms, and between said rotor and said casing in a shaft sealing portion in which the rotor extends through the casing.

8. The steam turbine of claim 4, wherein said seal body driving unit comprises an elastic member which pushes said seal body radially inwards of said rotor when the seal body moves radially outward of the rotor from a neutral position of the seal body, a pressure working surface which upon receipt of pressure from a fluid causes said seal body to move radially outwards of said rotor from a neutral position of said seal body, and a fluid supply unit for the supply of the fluid which imparts pressure to said pressure working surface.

9. The steam turbine of claim 8, wherein said fluid for imparting pressure to said pressure working surface is supplied from a system different from a system of a working fluid supplied to said rotor.

10. A steam turbine comprising:

a rotor with moving blades attached thereto;

diaphragms which surround said rotor from an outer periphery side of the rotor;

a casing which encloses said diaphragms and said rotor, said casing comprising an upper half and a lower half clamped together through respective flanges;

measuring means for measuring a difference in thermal expansion in the rotor axis direction between said casing and said rotor;

heating/cooling means attached to said flanges respectively to heat and cool the flanges;

a seal body disposed in a gap formed on the outer periphery side of said rotor, said seal body being annularly disposed facing said rotor and having a convex portion projecting toward the rotor;

a seal body driving unit for moving said seal body radially outwards of said rotor from a neutral position of the seal body; and a controller which makes control so as to cause said seal body to be retracted radially outwards of said rotor by said seal body driving unit at the time of the beginning of an unsteady operation, cause heating or cooling of said flanges to be started by said heating/cooling means, start or stop the introduction of steam into said casing when a measured value obtained by said measuring means reaches a first preset value, said first preset value representing a timing for heating or cooling said rotor and said casing with steam, stop the heating or cooling of said flanges performed by said heating/cooling means when said measured value reaches a second preset value, said second preset value representing a timing for heating or cooling said rotor and said casing with only steam, and cause said seal body to be returned to an original position of said seal body by said seal body driving unit when said measured value reaches a third preset value, said third preset value representing a timing of termination of the thermal expansion of said rotor and said casing.

11. A sealing device provided in a steam turbine, said steam turbine comprising a rotor with moving blades attached thereto, diaphragms which surround said rotor from an outer periphery side of the rotor, and a casing which encloses said diaphragms and said rotor, said casing comprising an upper half and a lower half clamped together through respective flanges, said sealing device comprising:

measuring means for measuring a difference in thermal expansion in the rotor axis direction between said casing and said rotor;

heating/cooling means attached to said flanges respectively to heat and cool the flanges;

a seal body disposed in a gap formed on the outer periphery side of said rotor, said seal body being annularly disposed facing said rotor and having a convex portion projecting toward the rotor;

a seal body driving unit for moving said seal body radially outwards of said rotor from a neutral position of the seal body; and a controller which makes control so that said flanges are heated or cooled by said heating/cooling means until a measured value obtained by said measuring means reaches a preset value in unsteady operation and so that the seal body is retracted radially outwards of said rotor by said seal body driving unit when said measured value reaches another present value for preventing contact of the convex portion of said seal body with another member, the former preset value representing a timing for heating or cooling said rotor and said casing with only steam.

12. A method for controlling a steam turbine, said steam turbine comprising:

a rotor with moving blades attached thereto;

diaphragms which surround said rotor from an outer periphery side of the rotor;

a casing which encloses said diaphragms and said rotor, said casing comprising an upper half and a lower half clamped together through respective flanges;

measuring means for measuring a difference in thermal expansion in the rotor axis direction between said casing and said rotor; and heating/cooling means attached to said flanges respectively to heat and cool the flanges, said method comprising:

causing heating or cooling of said flanges to be started by said heating/cooling means when starting unsteady operation;

starting or stopping the introduction of steam into said casing when a measured value obtained by said measuring means reaches a preset value representing a timing for heating or cooling said rotor and said casing with steam; and stopping the heating or cooling of said flanges performed by said heating/cooling means when said measured value reaches another preset value representing a timing for heating or cooling said rotor and said casing with only steam.

13. A method for controlling a steam turbine, said steam turbine comprising:

a rotor with moving blades attached thereto;

diaphragms which surrounds said rotor from an outer periphery side of the rotor;

a casing which encloses said diaphragms and said rotor, said casing comprising an upper half and a lower half clamped together through respective flanges;

measuring means for measuring a difference in thermal expansion in the rotor axis direction between said casing and said rotor;

heating/cooling means attached to said flanges respectively to heat and cool the flanges;

a seal body disposed in a gap formed on the outer periphery side of said rotor, said seal body being annularly disposed facing said rotor and having a convex portion projecting toward the rotor; and a seal body driving unit for moving said seal body radially outwards of said rotor from a neutral position of the seal body, said method comprising:

causing heating or cooling of said flanges to be started by said heating/cooling means when starting unsteady operation, starting or stopping the introduction of steam into said casing when a measured value obtained by said measuring means reaches a first preset value, said first preset value representing a timing for heating or cooling said rotor and said casing with steam, stopping the heating or cooling of said flanges performed by said heating/cooling means when said measured value reaches a second preset value, said second present value representing a timing for heating or cooling said rotor and said casing with only steam, and causing said seal body to be retracted radially outwards of said rotor by said seal body driving unit when said measured value reaches a third preset value, said third preset value being used for preventing contact of the convex portion of said seal body with another member.

14. A method for controlling a steam turbine, said steam turbine comprising:

a rotor with moving blades attached thereto;

diaphragms which surround said rotor from an outer periphery side of the rotor;

a casing which encloses said diaphragms and said rotor, said casing comprising an upper half and a lower half clamped together through respective flanges;

measuring means for measuring a difference in thermal expansion in the rotor axis direction between said casing and said rotor;

heating/cooling means attached to said flanges respectively to heat and cool the flanges;

a seal body disposed in a gap formed on the outer periphery side of said rotor, seal body being annularly disposed facing said rotor and having a convex portion projecting toward the rotor; and a seal body driving unit for moving said seal body radially outwards of said rotor from a neutral position of the seal body, said method comprising:

causing said seal body to be retracted radially outwards of said rotor by said seal body driving unit when starting unsteady operation, starting or stopping the introduction of steam into said casing when a measured value obtained by said measuring means reaches a first preset value, said first preset value representing a timing for heating or cooling said rotor and said casing with steam, stopping the heating or cooling of the flanges performed by said heating/cooling means when said measured value reaches a second preset value, said second preset value representing a timing for heating or cooling said rotor or said casing with only steam, and causing said seal body to be returned to an original position of said seal body by said seal body driving unit when said measured value reaches a third preset value, said third preset value representing a timing at which the operation of the steam turbine can be shifted to steady operation.

15. A method for controlling a sealing device provided in a steam turbine, said steam turbine comprising a rotor with moving blades attached thereto, diaphragms which surround said rotor from an outer periphery side of the rotor, and a casing which encloses said diaphragms and said rotor, said casing comprising an upper half and a lower half clamped together through respective flanges, said sealing device comprising:

measuring means for measuring a difference in thermal expansion in the rotor axis direction between said casing and said rotor;

heating/cooling means attached to said flanges respectively to heat or cool the flanges;

a seal body disposed in a gap formed on the outer periphery side of said rotor, said seal body being annularly disposed facing said rotor and having a convex portion projecting toward the rotor; and a seal body driving unit for moving said seal body radially outwards of said rotor from a neutral position of the seal body, said method comprising:

causing heating or cooling of said flanges to be started by said heating/cooling means when starting unsteady operation;

starting or stopping the introduction of steam into said casing when a measured value obtained by said measuring means reaches a first preset value, said first preset value representing a timing for heating or cooling said rotor and said casing with steam;

stopping the heating or cooling of said flanges performed by said heating/cooling means when said measured value reaches a second preset value, said second present value representing a timing for heating or cooling said rotor and said casing with only steam; and causing said seal body to be retracted radially outwards of said rotor by said seal body driving unit when said measured value reaches a third preset value, said third preset value being used for preventing contact of the convex portion of said seal body with another member.

* * * * *